US007398913B2

(12) United States Patent
McClure

(10) Patent No.: US 7,398,913 B2
(45) Date of Patent: Jul. 15, 2008

(54) COMBO BIN BAG CATCH AND METHOD OF USE

(75) Inventor: Jack A. McClure, Omaha, NE (US)

(73) Assignee: Weyerhaeuser Co., Federal Way, WA (US)

( * ) Notice: Subject to any disclaimer, the term of this patent is extended or adjusted under 35 U.S.C. 154(b) by 299 days.

(21) Appl. No.: 11/240,337

(22) Filed: Sep. 30, 2005

(65) Prior Publication Data

US 2007/0075124 A1 Apr. 5, 2007

(51) Int. Cl.
*B65D 5/60* (2006.01)
*B65D 25/16* (2006.01)

(52) U.S. Cl. ..... 229/117.35; 220/495.08; 220/495.11; 220/908.1

(58) Field of Classification Search ..... 229/117.35; 220/495.08, 495.09, 495.1, 495.11, 676, 220/908.1, 910
See application file for complete search history.

(56) References Cited

U.S. PATENT DOCUMENTS 3,684,155 A * 8/1972 Smith ..... 229/117.07
3,825,150 A * 7/1974 Taylor ..... 220/495.08
4,457,483 A * 7/1984 Gagne ..... 248/97
5,054,724 A * 10/1991 Hutcheson ..... 248/97
5,271,589 A * 12/1993 Belous ..... 248/97
5,419,452 A * 5/1995 Mueller et al. ..... 220/495.08
5,695,088 A * 12/1997 Kasbohm ..... 220/495.11
6,007,030 A * 12/1999 Judge ..... 248/95
D445,980 S * 7/2001 Tjugum ..... D32/61
6,659,407 B2 * 12/2003 Asaro ..... 248/97
6,824,042 B2 * 11/2004 Chu ..... 229/122.21
2002/0096524 A1 * 7/2002 Hardesty ..... 220/495.08
2006/0056741 A1 * 3/2006 Yang et al. ..... 383/33

* cited by examiner

*Primary Examiner*—Gary E Elkins

(57) ABSTRACT

The present invention is useful with any variety of bulk container designs that incorporate an internal bag within the container. The present invention uses a simple structure formed in the side walls of the container that will not only hold the bag open within the container during filling, but will also keep the bag attached to the container when the container in emptied. The bag catch assembly includes various cut lines that define a bag catch tab. Additionally another cut line(s) forms a bag retainer slit.

3 Claims, 5 Drawing Sheets

COMBO BIN BAG CATCH AND METHOD OF USE

FIELD OF THE INVENTION

This invention relates generally to cellulose-based blanks and containers employing internal bags, and more specifically to structure and method of retaining the bag inside the container during the filling and emptying of the container.

BACKGROUND

Bulk containers using internal bags are known in the art. For example, the meat industry has long used a bag inside a box combination to store and ship their various products. The bag is typically used to keep liquids from spilling and the container provides structure to the bag and its contents.

Until this invention there has been no simple way to keep the bag open within the container while the bag/container is being filled. Likewise, there has been no simple way to keep the bag attached to the container when the container is being emptied. These problems may seem trivial; however, much time is lost in packaging plants reopening a bag that has closed or partially closed during the filling process. Likewise much time and product is lost when, for example, bulk meat containers are emptied into grinding machines and the bag separates from the container and enters the grinding machine. In such a case, the grinder and its contents are contaminated and the product must be thrown away.

BRIEF DESCRIPTION OF THE DRAWINGS

Various embodiments of the present invention are described in detail below with reference to the following drawings.

DETAILED DESCRIPTION

The present invention provides a blank and a resulting container using a unique bag catch structure designed to hold a bag open inside the container while the container/bag are being filled, and to retain that bag with the container when the container/bag is emptied. By way of overview and with reference to FIGS. 1 through 5, an embodiment of the present invention includes a single piece blank 20 of formable material that may be arranged to form a container 30, including a bag catch assembly 27. Specific details of the blank 20 and container 30 are described with more particularity below.

Figure 1:
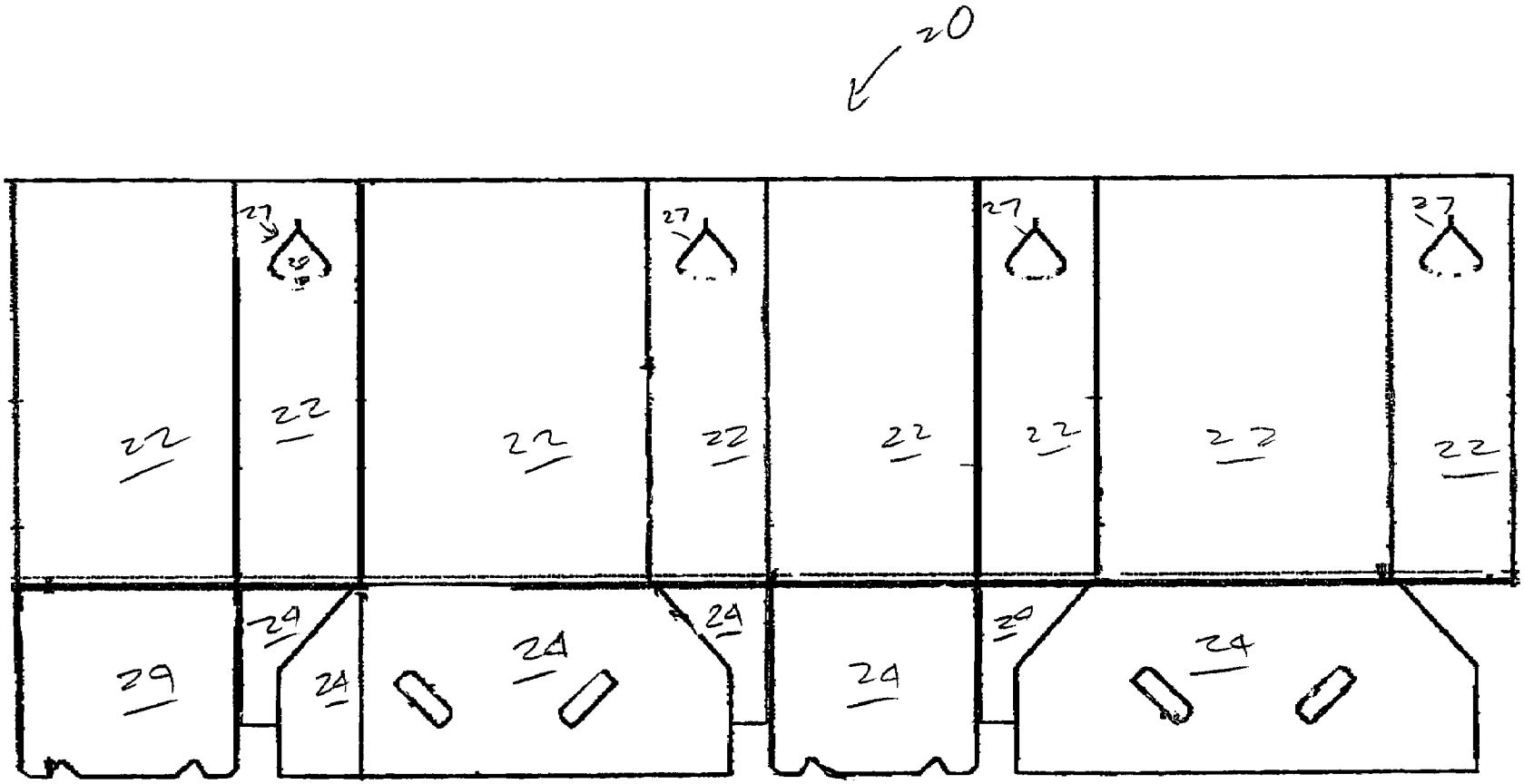
FIG. 1 is a plan view of a single piece container blank formed in accordance with an aspect of the present invention.

FIG. 1 depicts the blank 20 used to form the container 30. The blank 20 and the container 30 include a bag catch assembly 27. The blank 20 is preferably constructed from a single piece of formable material such as, without limitation, sheets of cellulose-based materials formed from cellulose materials such as wood pulp, straw, cotton, bagasse, or the like. Cellulose-based materials used in the present invention come in many forms such as fiberboard, containerboard, corrugated containerboard and paperboard. Likewise, additional forms may include singlewall, doublewall and triplewall containers. The blank 20 is cut and scored, perforated or other formed to include a plurality of panels that when assembled form container 30. In all figures, like numbers indicate like parts. Additionally, cut lines are shown as solid lines, score lines as dashed lines, and lines of perforation as broken lines.

With continued reference to FIG. 1, the blank 20 depicts what is commonly known in the container industry as a combo bin. As combo bins specifically, and bulk bins generally, are know in the art, a detailed description is not necessary herein to understand the various aspects of the present invention. Additionally, the specific shape or geometry of the container 30 is not intended to be a limiting factor with this invention. The present invention may be used with any style of container 30 having any geometry. The blank 20 includes a variety of side panels 22 that are arranged to form the sides of the container 30 when it is formed. Also the blank 20 includes a variety of bottom panels 24 that when the container is erected form the bottom closure of the container 30. As depicted in this FIGURE, the container is an 8-sided, octagon-shaped box. However, as stated above, the container 30 may be square, rectangular, trapezoidal or any other geometric shape without defeating the spirit and scope of the present invention. As such, the relative shape and locations of the various side panels 24 and bottom panels 24 is dependent upon the container 30 design.

Disposed in a region near the upper portion of the erect container 30 are the bag catch assemblies 27. The region having the bag catch assemblies 27 is generally a region opposite the bottom panels 24. As depicted in this FIGURE, the bag catch assemblies 27 are disposed on every other panel—specifically in this combo bin model, the bag catch assemblies 27 are positioned on the angular panels of the combo bin. However, as seen in later FIGURES, the bag catch assembly 27 may be positioned on more or fewer side panels 22 based upon the size and geometry of the container 30. The optimal bag catch assembly 27 location may be reasonably determined by those skilled in the art. It will be appreciated that one consideration with regards to placing the bag catch assemblies 27 on the side panels 22 is placing the bag catch assemblies 27 in those locations that may reduce any possible tearing of the side wall 22.

Figure 2:
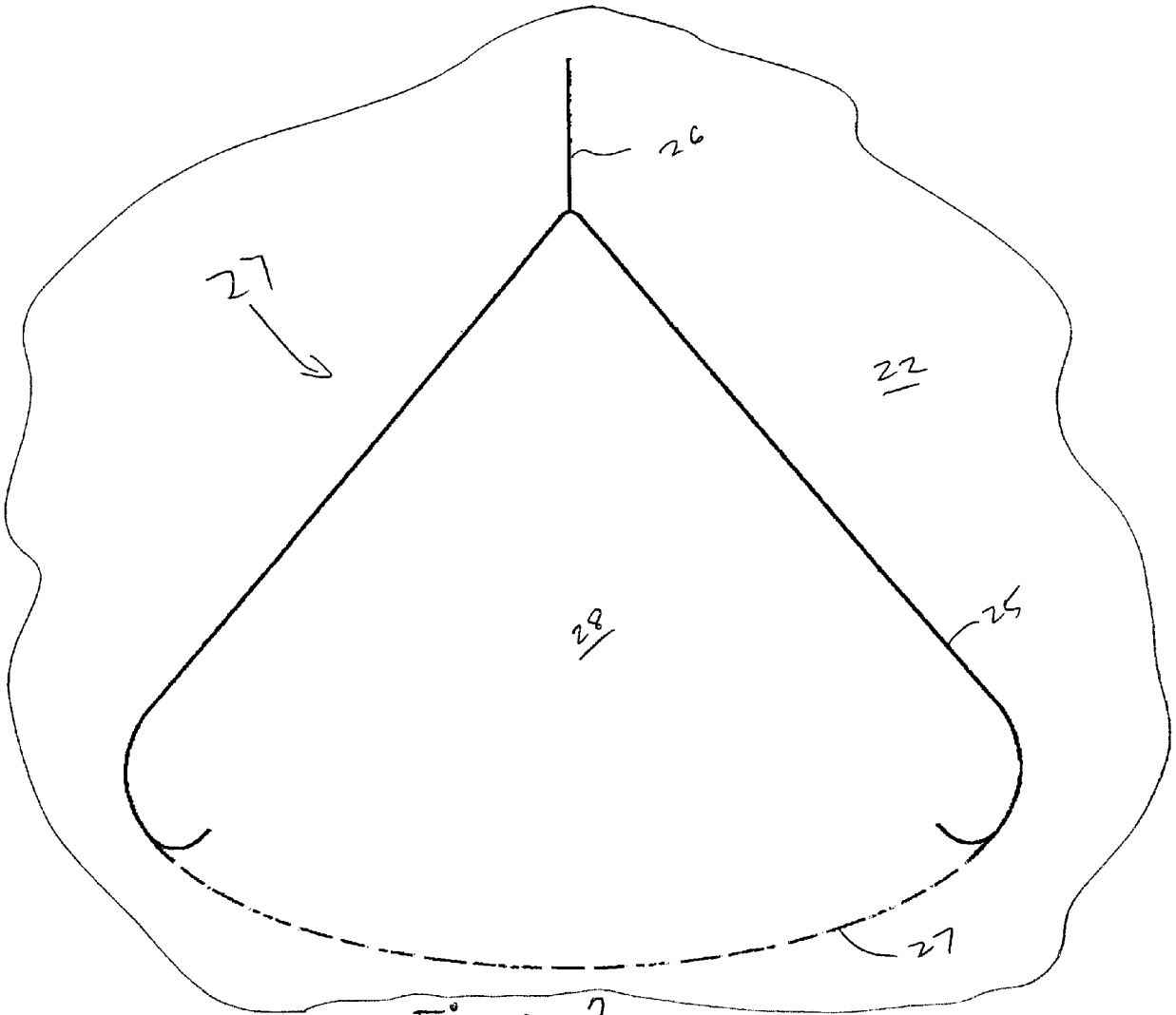
FIG. 2 is a plan view of an aspect of the bag catch assembly according to an aspect of the present invention.

With specific reference to FIG. 2, one aspect of the bag catch assembly 27 is shown in further detail. The bag catch assembly 27 is formed in the side panel 22. The bag catch assembly 27 includes, in this configuration, a radius hinged line 29 that forms into a cut line 25. Cut line 25 is in a shape of an inverted "V" where the apex of the V-shaped cut line 25 extends a retainer slit 26. It will be appreciated that other cut line shapes may be used, such as, without limitation, U-shaped. The retainer slit 26 extends substantially vertically from the apex of the V-shaped cut line 25. The dimensions of the retainer slit 26 will be readily attainable of those skilled in the art, as it will be a function of the size and style or type of bag 29 that is employed within the container 29. As such, the retainer slit 26 may be a simple cut line if the bag 29 is relatively thin, or the retainer slit 26 may be a cut-out or for a larger, or thicker bag 29.

Figure 3:
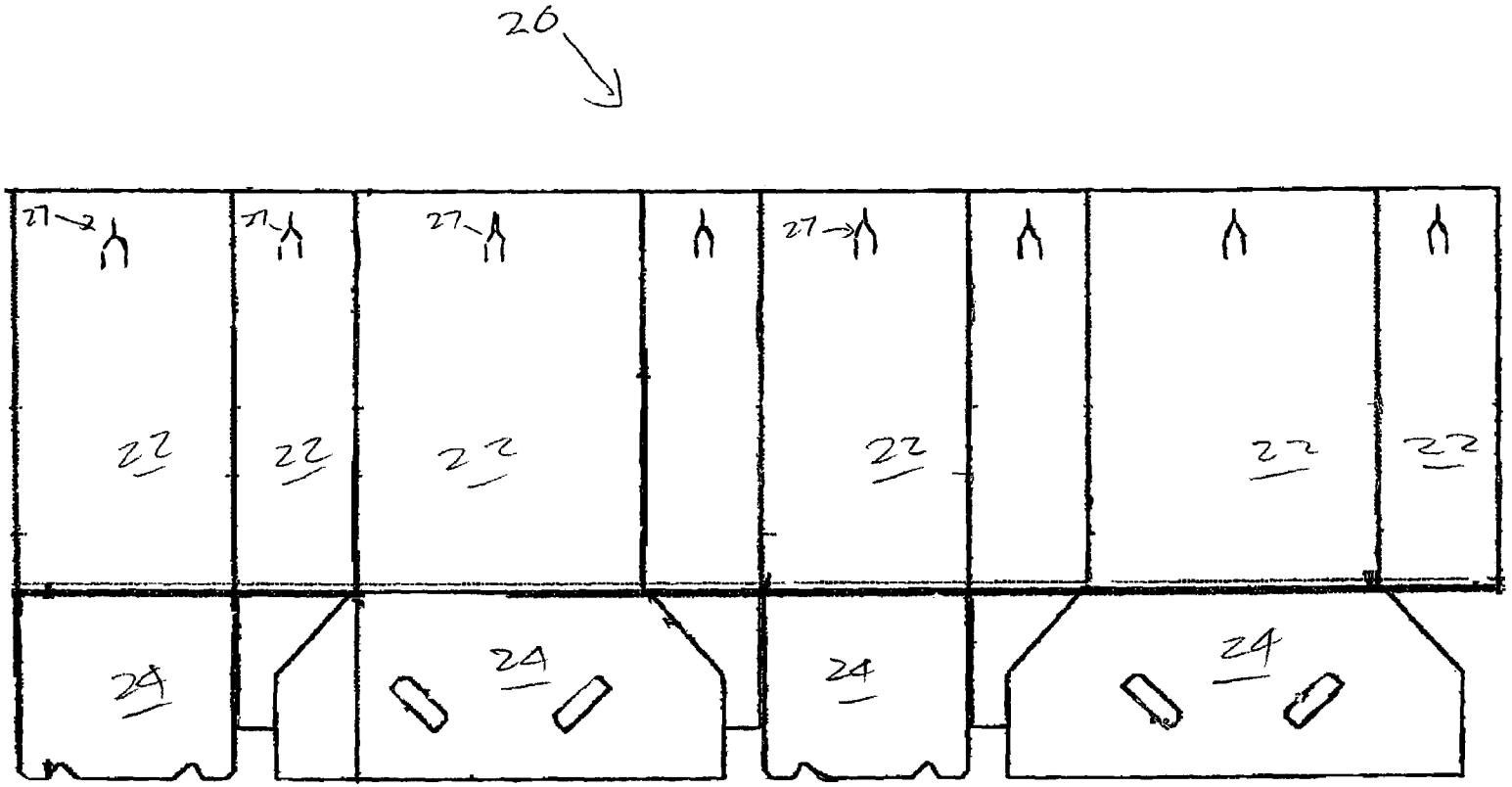
FIG. 3 is a plan view of another single piece of container blank formed in accordance with yet another aspect of the present invention.

With specific reference to FIG. 3, another blank 20 is shown with depicting yet another aspect of the bag catch assembly 27. Specifically, this bag catch assembly 27 is disposed upon every side panel 22 of the blank 20. Also the location of the bag catch assembly 27 in this configuration is centrally located on each of the side panels 22. Again, however, the position of the bag catch assembly 27 within the side panel 22 and the number of side panels 22 in a give container 30 which actually included in bag catch assembly 27 is variable and dependent upon the design requirements and is not intended to limit the scope of the present invention.

Figure 4:
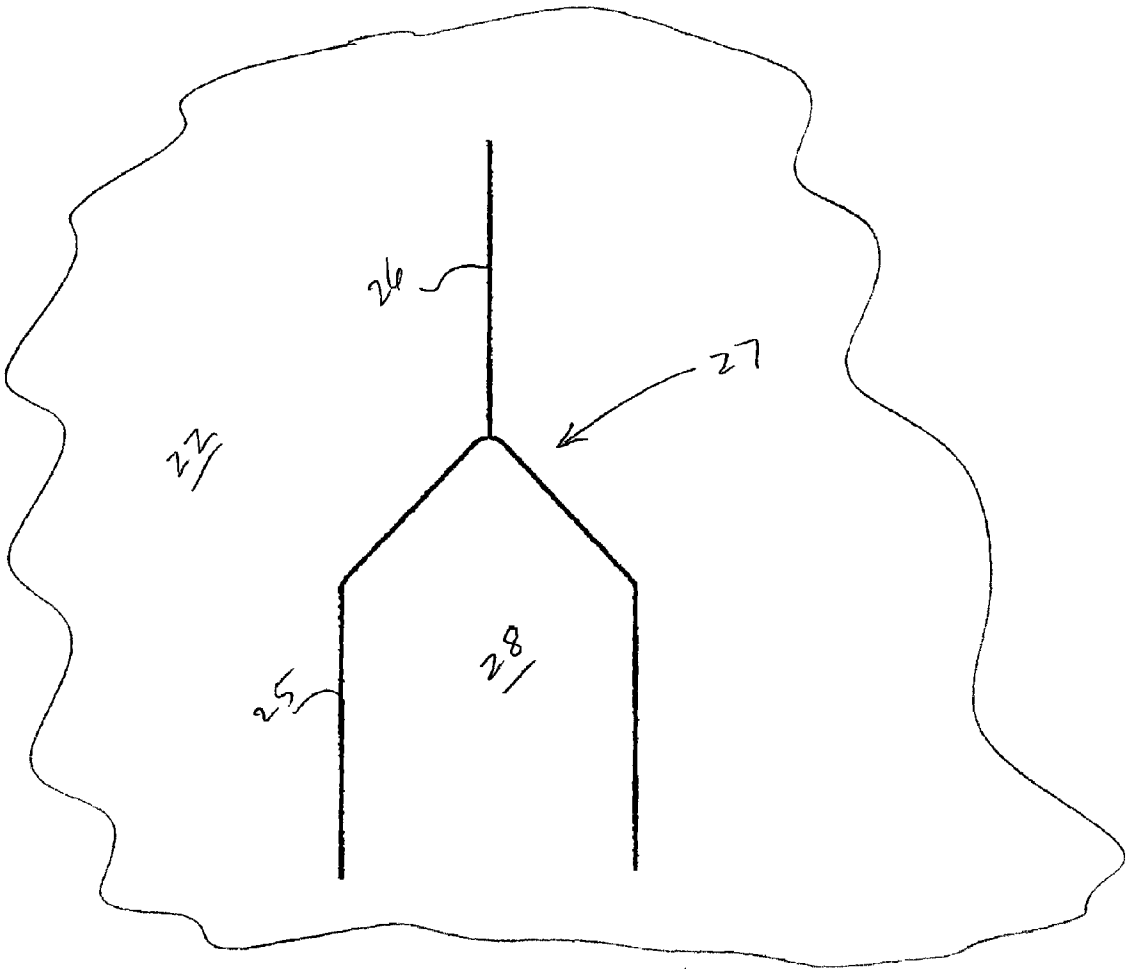
FIG. 4 is a plan view of an aspect of the bag catch tab constructed according to an aspect of the present invention.

With specific reference to FIG. 4, a more detailed view of the bag catch assembly 27 disclosed in FIG. 3 is depicted. Specifically, this bag catch assembly 27 includes, much like the previous one, a substantially V-shaped cut line 25 wherein extending from an apex in a vertical direction is the bag retainer slit 26. In this configuration, the bag catch assembly 27 does not include a radius or score line across the opposed ends of the cut line 25. However, it will be appreciated that a score line may be included across the two end points of the V-shaped cut line 25 in order to increase the ease in which the bag catch tab 28 may be displaced.

Figure 5:
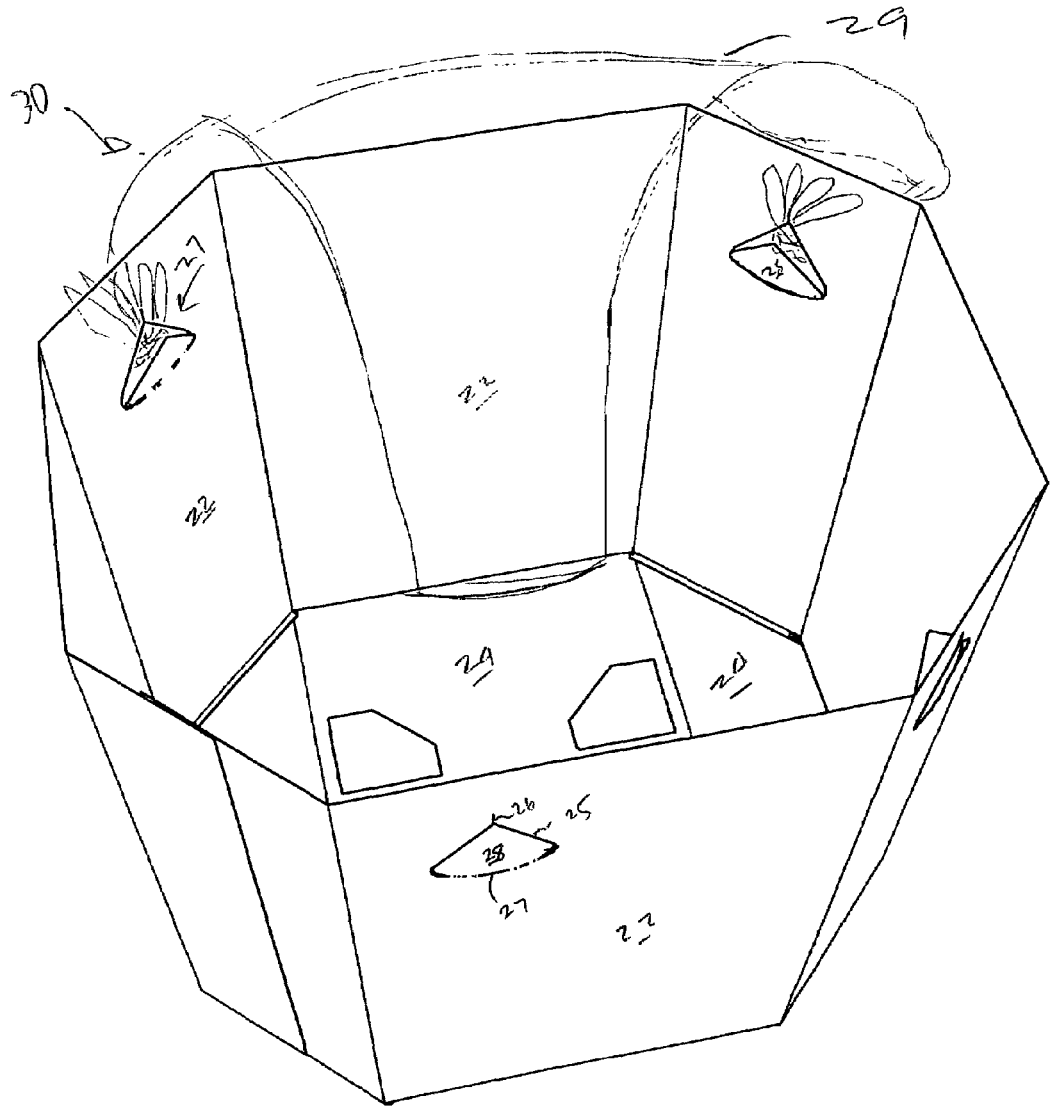
FIG. 5 is a perspective view of the container incorporating an aspect of the bad catch according to the present intention.

FIG. 5 depicts another aspect of the present invention. Specifically, an erect container 30 includes an internal bag 29 engaged with the bag catch assembly 27. The nature of the bag 29 is any bag commonly used in the bulk packaging art. One suitable, nonlimiting example includes a bag 29 made from a polymer based material. Specifically, as can be seen on the side panels 22, the bag catch tab 28 is pushed in towards the inside of the container 30 so a portion of a free end of the bag 29 may be stuffed through the opening created by displaced the bag catch tab 28. A portion of bag 29 may then be pulled up into the retainer slit 26. The retainer slit 26 acts to lock the bag 29 with the container 30. The bag catch assembly 27 will keep the bag 29 open during filling, and also prevent the bag 29 from separating from the container 30 while being emptied.

The present invention also includes a method of retaining a bag 29 within a container 30. Specifically, a bag 29 is inserted into a container such that an open end of the bag is draped over the top edge of the container 30. A portion of the open end of the bag 29 can then be pushed against the bag catch tab 28 thereby displacing the bag catch tab 28 and allowing a portion of the bag 29 to be inserted into the opening. The bag 29 may then be pulled upwardly into the retainer slit 26, thereby binding the bag in a semi-locked position with the side wall 22.

It will be appreciated that once the bag 29 is inserted into the container 30 and engaged with the bag catch assemblies 27 as discussed above, that the bag 29 will be held open during filling. Also, upon being filled, the contents within the bag will help push the bag catch tab 28 back toward its pre-displaced location, thus binding the bag 29 there between, thereby further helping to secure the bag 29 to the container 30. Also if the container 30 is inverted to empty product, the bag catch assembly will keep the bag 29 with the container 30.

While various embodiments of the invention have been illustrated and described, as noted above, many changes can be made without departing from the spirit and scope of this invention. Accordingly, the scope of the invention is not limited by the disclosure of the various embodiments; instead the invention should be determined entirely by reference to the claims that follow.

What is claimed is:

1. A single sheet of foldable material cut and scored to define a container blank, comprising:

a plurality of side panels, each side panel having a first end and a second end;

a bottom panel connected with at least one of the side panels adjacent the first end of the at least one side panel;

a bag catch tab formed in one of the side panels substantially adjacent the second end of the respective side panel, a portion of said bag catch tab being defined by a cut line extending through the side panel and another portion of the bag catch being defined by an uncut region within the side panel, the cut line being substantially V-shaped, the ends of the V defining a first cut line point and a second cut line point, the bag catch tab further comprising a radius score line connecting the first cut line point and the second cut line point; and, a retainer slit extending from a region of the cut line in a direction toward the second end of the respective side panel.

2. The container blank of claim 1, wherein the single sheet of foldable material is formed from a cellulose-based material.

3. The container blank of claim 2, wherein the cellulose based material is in the form of at least one of a fiberboard, containerboard, corrugated containerboard and paperboard.

* * * * *